US005416454A

United States Patent [19]

McVeety

[11] Patent Number: 5,416,454

[45] Date of Patent: May 16, 1995

[54] STRIPLINE FILTER WITH A HIGH SIDE TRANSMISSION ZERO

[75] Inventor: Thomas G. McVeety, Albuquerque, N. Mex.

[73] Assignee: Motorola, Inc., Schaumburg, Ill.

[21] Appl. No.: 221,713

[22] Filed: Mar. 31, 1994

[51] Int. Cl.[6] ..... H01P 1/203

[52] U.S. Cl. ..... 333/204; 333/134

[58] Field of Search ..... 333/203–205, 333/219, 235, 134

[56] References Cited

U.S. PATENT DOCUMENTS

| | | | |
|---|---|---|---|
| 4,418,324 | 11/1983 | Higgins | 333/204 |
| 4,975,664 | 12/1990 | Ito et al. | 333/205 |
| 5,321,374 | 6/1994 | Uwano | 333/205 |
| 5,344,695 | 9/1994 | Hirai et al. | 333/205 |

FOREIGN PATENT DOCUMENTS

| | | | |
|---|---|---|---|
| 0163401 | 7/1987 | Japan | 333/204 |
| 0063403 | 3/1993 | Japan | 333/204 |
| 0211404 | 8/1993 | Japan | 333/205 |

*Primary Examiner*—Seungsook Ham
*Attorney, Agent, or Firm*—Gary J. Cunningham

[57] ABSTRACT

A so-called stripline filter (10)is provided, having three poles and one zero in its frequency transfer function. The stripline filter (10) includes a base (12), at least three conductive strips (18, 20 and 22), input and output pads (24 and 26), a cover (28) and an inductive transmission line (38) coupled in such a fashion to provide a desired frequency response with a high side transmission zero.

17 Claims, 3 Drawing Sheets

FIG.1
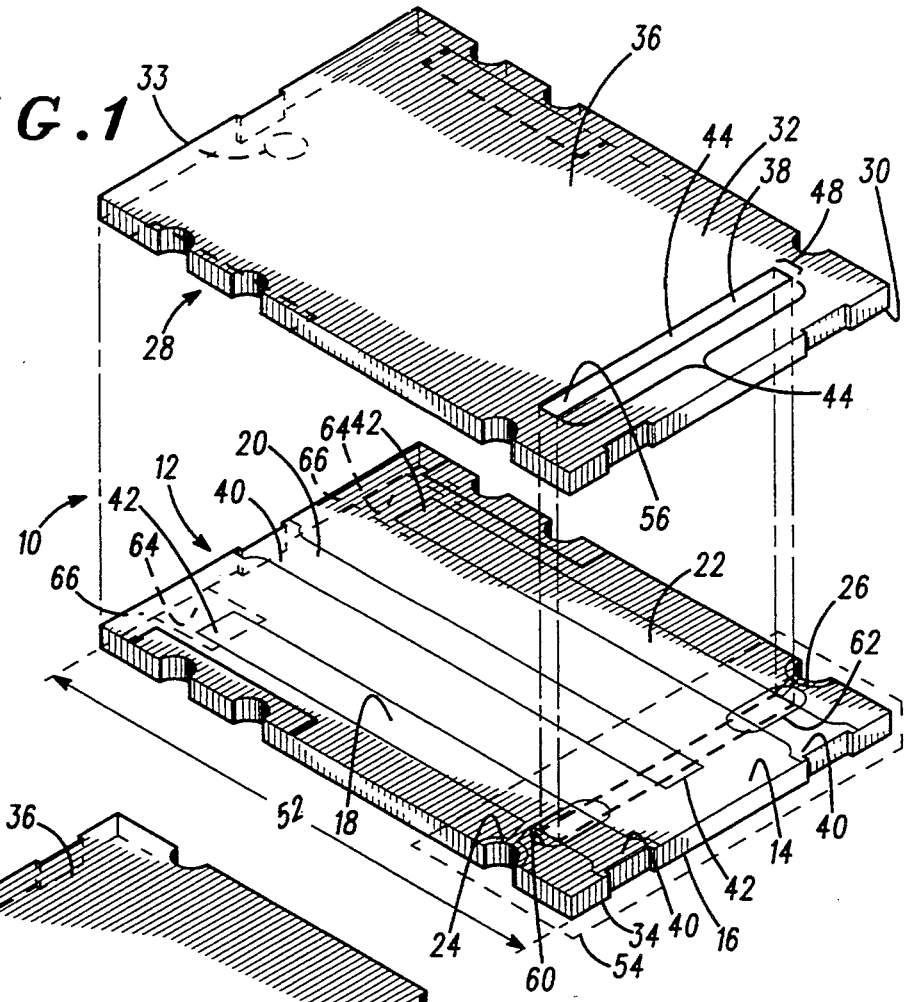
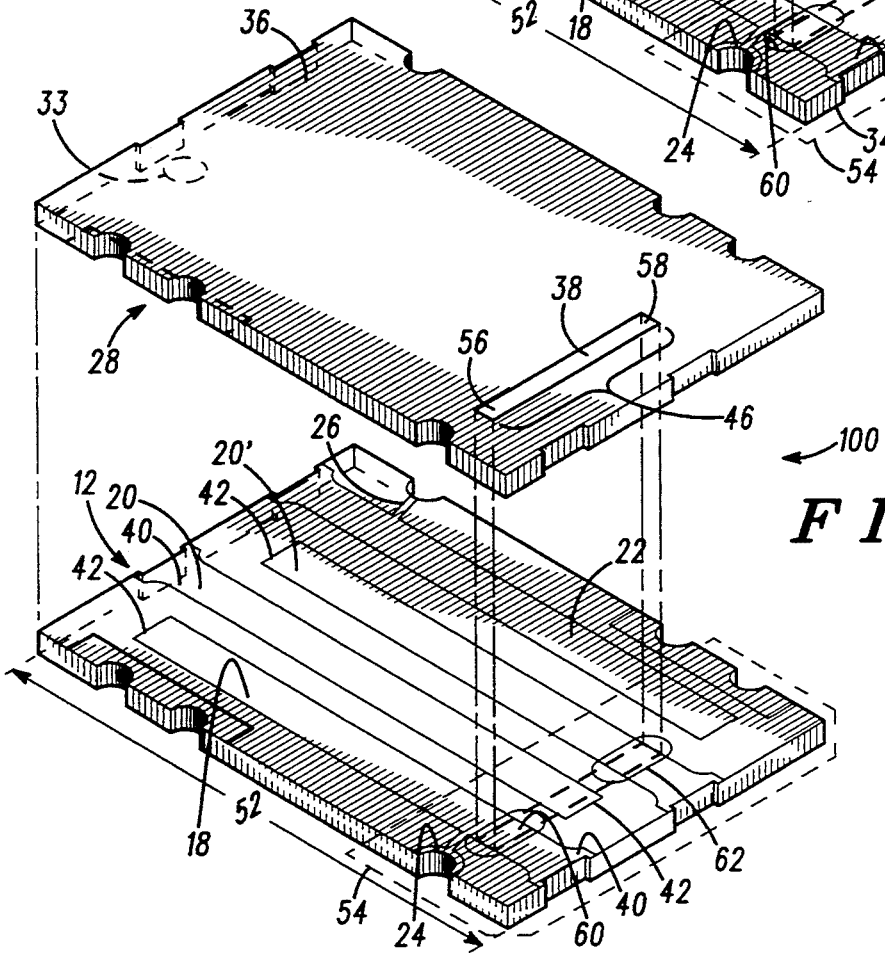
FIG.3

STRIPLINE FILTER WITH A HIGH SIDE TRANSMISSION ZERO

FIELD OF THE INVENTION

The present invention relates generally to electrical filters, and more particularly to so-called stripline filters.

BACKGROUND OF THE INVENTION

The term stripline as used herein, generally refers to structures which include a layer of dielectric material having opposing surfaces on which respective layers of electrically conductive material are disposed. One or more resonators are sandwiched within the dielectric layer to fabricate a stripline filter structure.

Generally, stripline filters can have various frequency responses which can resemble bell-shaped curves and the like.

Stripline filters are typically used as injection filters, for example, and include a frequency response characteristic with a desired bandpass. Each conductive strip defines a pole in the transfer function of the filter.

A conventional wide bandwidth filter can be modified, as described more fully herein, by making certain adjustments in the design. A wider bandwidth reduces the insertion loss of the filter, but, it also reduces the filter's attentuation of the unwanted frequency. The addition of a transmission zero in the transfer function at the frequency of the unwanted signal, could effectively improve the performance of a stripline filter, as described herein.

It is considered an improvement in the art, if a structure could be devised which could modify stripline filters, to create an inductive transmission line near the grounded end of the resonators, to provide a high side zero transfer function.

The addition of a transmission zero in the transfer function at the frequency of the unwanted signal, could improve the performance of a stripline filter.

BRIEF DESCRIPTION OF THE DRAWINGS

FIG. 1 is an enlarged, exploded view of a three pole stripline filter, in accordance with the present invention.

FIG. 3 is an enlarged, exploded four pole stripline filter, in accordance with the present invention.

DETAILED DESCRIPTION OF THE PREFERRED EMBODIMENT

Figure 5:
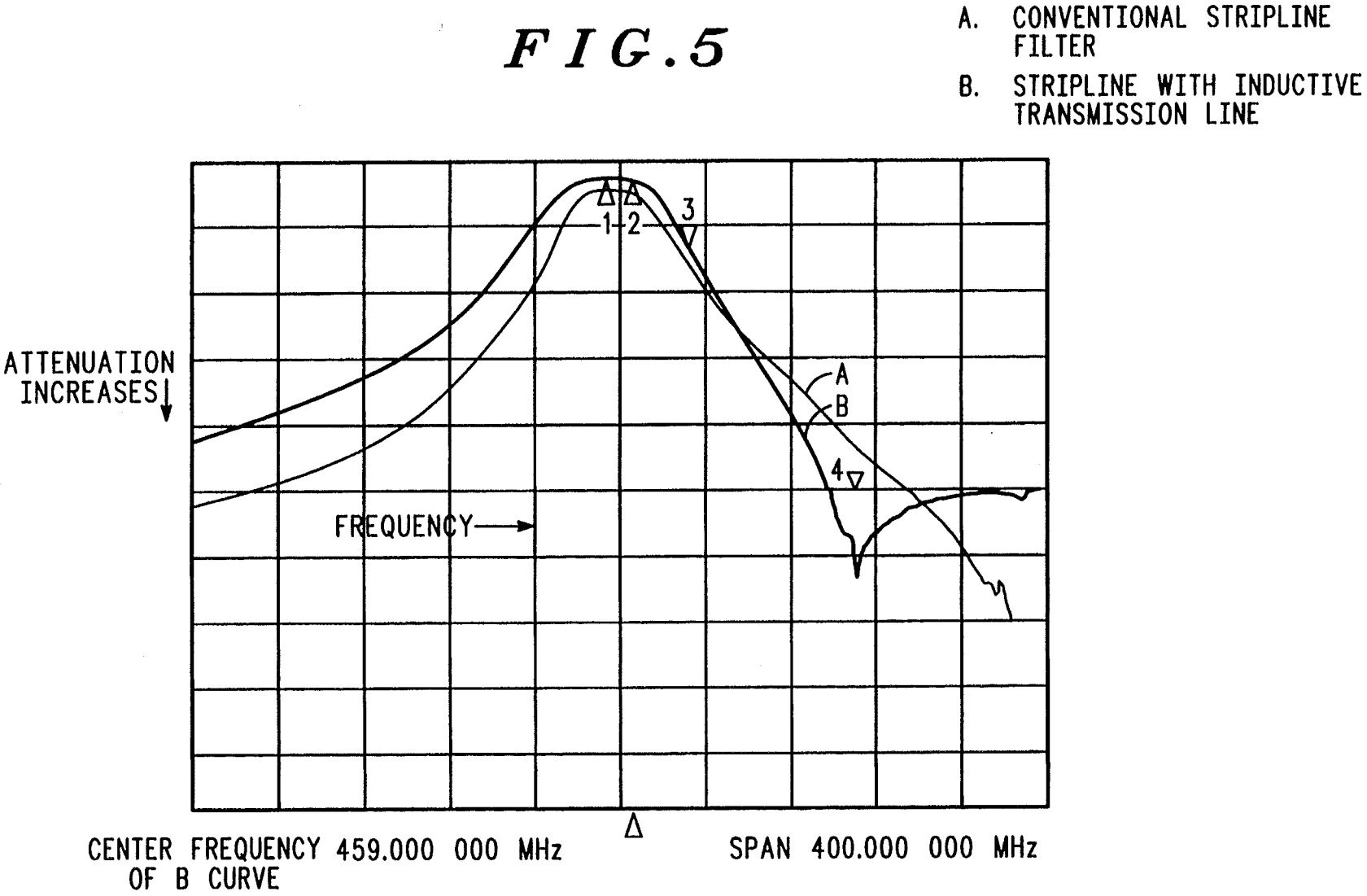
FIG. 5 shows the frequency response of a stripline filter substantially as shown in FIG. 1, in accordance with the present invention, compared to a conventional stripline filter without the inductive transmission line in FIGS. 1 and 2.

A stripline filter 10 having at least three poles and one zero in its frequency transfer function, is shown in FIG. 1. Generally, the stripline filter 10 includes a base 12, at least three conductive strips 18, 20 and 22, input and output pads 24 and 26, a cover 28, and an inductive transmission line 38, whereby a predetermined tunable frequency response with a high side transmission zero is obtainable, as shown in FIG. 5, for example.

In more detail, the stripline filter 10 includes a base 12 comprising an interior portion 14 and an exterior portion 16. The filter 10 also includes at least three conductive strips defining an input resonator 18, a middle resonator 20, and an output resonator 22 on the interior portion 14 of the base 12. The stripline filter 10 further includes input and output pads 24 and 26 connected to the input and output resonators 18 and 22, respectively. The filter 10 further includes a cover 28 including an interior portion 30 and an exterior portion 32. The exterior portion 16 of the base 12 and the exterior portion 32 of the cover 28 are substantially covered with a conductive material defining a ground plane, with the exception that a portion of the exterior 32 or 16 of the cover 28 or the base 12 is substantially uncoated to define a magnetic coupling device 38 for inductively coupling at least two alternate resonators in proximity to a grounded end 40, thereby providing a predetermined tunable frequency response with a high side transmission zero. In one embodiment, the frequency response is substantially similar to that shown in FIG. 5.

By placing a zero at a desired frequency, greater attenuation at that frequency may be obtained, than otherwise would be possible given the same number of poles. This is at the expense of the opposite side attenuation, however, this is usually not a deterrent, as the increased single sided attenuation is usually more desirable than simply symmetrical rejection, for many applications. To achieve this amount of attenuation, a greater number of poles would usually be required, at additional expense and at the cost of additional physical size. The fact that the high side zero in the filter 10 is tunable or controllable, increases its relative worth, because then a single general design can be easily modified to specific requirements.

In addition to these advantages, the bandwidth of the stripline filter 10 can be adjusted or increased, with improved insertion loss, and without degrading the attenuation. A high side transmission zero, helps to provide for more versatility of stripline filters, and modifications to external surfaces can be made fairly easily, without significant additional costs.

The interior portions 14 and 30 are substantially mirror images of each other, for assembly purposes, to suitably couple and attach the two substrates 12 and 28 together. Additionally, the filter 10 provides a double resonator mass provided by the mirror imaged interior portions 14 and 30, which increases the effective resonator mass and helps to increase electrical Q, improving electrical performance of the filter.

The magnetic coupling device 38 can also be defined as an inductive transmission line or path, comprising unmetallized dielectric material on the base 12, cover 28 or both, preferably the cover 28 for easy access. The inductive transmission line 38 couples at least two alternate resonators, such as the input and output resonators 18 and 22, to provide the desired frequency response. The inductive transmission line 38 couples the input and the output resonators 18 and 22 in proximity to the grounded ends 40 thereof, where most of the magnetic energy exists, thereby taking advantage of the magnetic energy in this area.

Each resonator 18, 20 and 22, includes a grounded end 40 coupled to the ground plane and an ungrounded area or end 42. The inductive transmission line 38 comprises a substantially unmetallized (non-conductive)

dielectric material 44, having a predetermined lateral length sufficient to couple the input and output resonators 18 and 22 and a predetermined width 48, to provide the desired inductive path.

The combination of the length 46 and width 48 contribute to determining the magnetic coupling impedance of the inductive transmission line 38. As the width 48 is increased, the amount of the magnetic coupling is correspondingly increased, thereby decreasing the impedance and causing the zero to move lower in frequency. In a preferred embodiment, the transmission line 38 is located approximately 30° or less from ground, on a quarter wavelength filter (90° resonator), as shown in phantom by item number 54, for suitable placement of the transmission zero.

The inductive transmission line 38 defines a path substantially isolated from the uncoupled resonator, or the middle resonator 20. Minimal or substantially no magnetic interaction occurs between the inductive transmission line 38 and the ungrounded end 42 of the middle resonator 20, because there is minimal or practically no magnetic energy at the ungrounded end 42 of the middle resonator 20.

Figure 4:
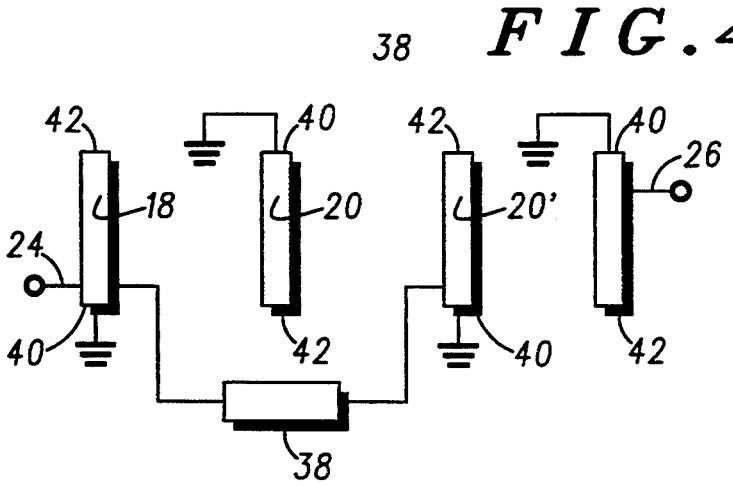
FIG. 4 is a representative circuit diagram of the filter shown in FIG. 3, in accordance with the present invention.

The inductive transmission line 38 comprises essentially a lateral void in the ground plane, which allows magnetic energy to substantially freely flow between the alternate resonators 18 and 22, because there is magnetic energy at the grounded ends 40 of the resonators 18 and 22. Similarly, in a four pole stripline filter, as shown in FIGS. 3 and 4, the same is true regarding the coupling of the grounded ends 40 of resonators 18 and 20'. The isolation or minimal magnetic (or inductive) coupling between the ungrounded end 42 of the middle resonator 20 and grounded ends 40 of the resonators 18 and 20' are minimal, as detailed above because only minimal magnetic energy is present in proximity to the ungrounded end 42 of resonator 20.

More particularly, the inductive transmission line 38 and the grounded end 40 of the middle resonator 20 are sufficiently spaced a predetermined distance, and suitably isolated to minimize unwanted coupling and output frequency responses.

Stated another way, the inductive transmission line 38 (or path) is substantially uncoupled to the middle resonator 20, and carefully placed about 30° or less from ground 40 of resonators 18 and 22, preferably about 10° to about 25°, and most preferably about 15° to about 20° from ground, as shown by area 54, for improved coupling, minimal interference and minimal required additional tuning, in proximity to the input and output pads 24 and 26, in a quarter wavelength filter in FIGS. 1 and 3. This is so to provide the desired frequency response, as shown for example, in FIG. 5. This can be accomplished because there is substantially minimal inductance of the ungrounded end 42 of the middle resonator 20, thus the transmission line 38 substantially only inductively couples the grounded ends 40 of the resonators 18 and 22 in FIGS. 1 and 2, and 18 and 20' in FIGS. 3 and 4.

By specifically arranging the relative positioning of the inductive transmission line 38 with respect to the grounded end 40 of the input and output resonators 18 and 22, a desired frequency response characteristic can be created which has a high side transmission zero, as shown in FIG. 5.

An outer ground plane void, provided by the inductive transmission line 38, will remove capacitive loading from the ungrounded end 42 of the middle resonator 20, which will (adjust or) raise the frequency of that particular resonator. By suitable positioning of the line 38, this affect can be minimized.

The transmission line 38, can be positioned on either the exterior portion 14 or 32 of the base 12 or cover 28, respectively, or both, and preferably is on the cover 28 exterior portion 32, as shown in FIG. 1, for ease of manufacturability and improved access if necessary. The line 38 can be formed by any suitable means such as by, masking in the electroding process, milling, dremmeling, grinding or the like, to form the transmission line 38, essentially defined by the non-conductive dielectric alone.

In the filters 10 and 100 in FIGS. 1 and 3, it is desirable that the resonant frequencies of the resonators be approximately similar.

As previously stated, the transmission line 38 typically removes some capacitive loading from the ungrounded end 42 of the middle resonator 20, which can cause detuning, or unwanted shifting, by raising the frequency of that particular resonator 20. By appropriate design, this affect can be minimized. For example, the length of the middle resonator 20 can be increased, to adjust and lower the frequency of that particular resonator to approach the center frequency of the other resonators 18 and 22, in FIG. 1, thereby making the middle resonator 20 longer than the input and output resonators 18 and 22. Alternatively, if the three resonators 18, 20 and 22 are substantially similar in length, a portion of the ground plane or conductive material 34 or 36 in proximity to and adjacent to the grounded end 40 of the middle resonator 20 can be removed (hereafter referred to as a tuned area 33 in FIG. 1), thereby tuning and lowering the frequency of the middle resonator 20, to approach the resonant frequencies of the other resonators 18 and 22, and thereby resulting in a desired frequency response, such as a bell shaped curve with an improved, lower insertion loss. The transmission line 38 tends to lower the frequency of the inner and outer resonators 18 and 22. To obtain the desired frequency response, tuning of the middle resonator 20 is recommended, preferably by removing some conductive material 36 in tuned area 33, for obtaining a frequency response, as shown in FIG. 5, for example.

The filter 10 has a length L, identified by item 52 which can range widely, and is typically sufficiently long to provide a quarter wavelength filter, typically about 0.32 inches (8 mm) to about 0.4 inches (10 mm), for filtering signals in the 800 MHz to 1 GHz range. In one embodiment, the filter 10 includes a dielectric value of approximately 70 to 80, when using a neodymium titanate as the dielectric. As should be understood by those skilled in the art, other dielectric materials, varying dimensions and dielectric values, and other modifications can be made in this invention provided the appropriate inductive coupling as detailed herein is achieved, without departing from the spirit and scope of the instant invention.

As previously stated, the transmission line 38 is positioned in proximity to the grounded end 40 of the input and output resonators 18 and 22, identified as ground area 54. In a preferred embodiment, the grounded area 54 is about one-third or less of the length 52, for accomplishing the desired coupling of resonators 18 and 22, without adversely affecting the frequency response of the filters 10 or 100, as detailed above.

The transmission line 38 is specially configured to provide a good magnetic coupling of the grounded ends 40 of resonators 18 and 22. In a preferred embodiment, the transmission line 38 has first and second lateral areas 56 and 58 which couple, connect, overlap and intersect with the adjacent grounded ends 40 of resonators 18 and 22, to provide the desired magnetic coupling. In a preferred embodiment, the areas 56 and 58 extend laterally (defining length 46), sufficiently to provide first and second overlap areas 60 and 62, defined by the area in proximity to were lateral areas 56 and 58 and grounded end 40 of the input and output resonators 18 and 22 intersect.

The transmission line 38 has a width 48 sufficient to provide a magnetic coupling of the grounded ends 40 of resonators 18 and 22, to obtain the desired frequency response. In a preferred embodiment, the width is sufficient to place the transmission zero at the desired location in the frequency response curve. Generally, the wider the width 48 the lower the impedance provided by line 38, which decreases (or lowers) the zero in frequency. In a preferred embodiment, the width 48 is configured to suitably place the transmission zero at the appropriate position, above the pass band in FIG. 5.

As should be understood by those skilled in the art, various modifications to the transmission line 38 and filters 10 and 100 can be made by those skilled in the art, without departing from the spirit and scope of this invention.

Figure 2:
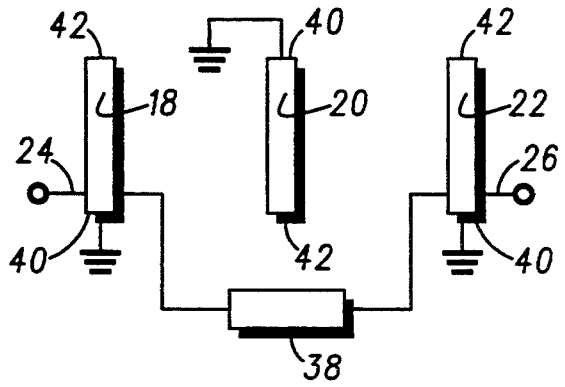
FIG. 2 is a representative circuit diagram of the filter shown in FIG. 1, in accordance with the present invention.

Referring to FIG. 2, a representative schematic representation of the filter 10 in FIG. 1 is shown, to provide a frequency response similar to that shown in FIG. 5.

In FIGS. 3 and 4 a four pole stripline filter 100 is shown. The stripline filter in FIG. 3 includes much of the structure, as indicated by like numbers, as detailed previously in FIG. 1. The stripline filter 100 has a plurality of poles and one zero in its frequency transfer function, substantially similar to that shown in FIG. 5. A major advantage to the four pole filter 100, is improved ultimate attenuation.

The four pole filter 100, can include: a base 12 including an interior portion 14 and an exterior portion 16; at least four conductive strips defined by an input resonator 18, a first and second middle resonator 20 and 20', and an output resonator 22 on the interior portion 14 of the base 12; input and output pads 24 and 26 connected to the input and output resonators 18 and 22, respectively; and a cover 28 comprising an interior portion 30 and an exterior portion 32, the exterior portion 16 of the base 12 and the exterior portion 32 of the cover 28 are substantially covered with a conductive material 34 and 36, respectively, defining a ground plane, with the exception that at least a portion of the exterior portion of the cover or the base 28 or 12, or both, is substantially uncoated, to define an inductive transmission line 38, for coupling at least two alternate resonators in proximity to a grounded end 40 thereof, thereby providing a predetermined tunable frequency response with a high side transmission zero.

In FIGS. 1 and 3, the input and output ports 24 and 26 are shown inductively coupled to the grounded ends 40 of the first and third resonators 18 and 22 in FIGS. 1 and 3.

In an alternate embodiment, in lieu of the inductively coupled input/output pads shown as 24 and 26, the dashed input/output pads 64 surrounded by non-conductive areas 66 can be utilized for connecting the filter 10 to appropriate external circuitry. These pads 64 would be preferably positioned on the external portion 14 of the base 12, as shown in FIG. 1. This structure provides capacitive coupling of the input and output pads 64 to the ungrounded ends 42 of the input and output resonators 18 and 22, for improved surface mounting. Pads 64 could be placed on external portions 16 or 32, preferably external portion 16 for simplified surface mounting to a circuit board, for example.

In FIGS. 3 and 4, input resonator 18 and the second middle resonator 20' are coupled via the inductive transmission line 38, having the benefits and advantages as previously described with respect to FIGS. 1 and 2.

In one embodiment, there can be more than four resonators. For example, there could be five or more resonators including a third middle resonator, and wherein the first and third middle resonators are coupled via an inductive transmission line 38 at the grounded end 40, for providing a desired high side transmission zero, for example, with improved ultimate attenuation.

A four pole filter offers improved ultimate attenuation, generally at the expense of increased insertion loss. The transmission zero provided in filter 100 effectively adds, at little or no cost, an additional pole of filtering, for obtaining a desired frequency response similar to that shown in FIG. 5.

COMPARATIVE EXAMPLES

In Comparative Example A, a conventional stripline filter substantially similar to that shown in FIG. 1 was tested, but without the inductive transmission line 38, as shown as item A, in FIG. 5. The conventional stripline filter was a three pole filter with input/output pads 24 and 26 as shown in FIG. 1, and the dielectric was a Neodymium Titanate with a dielectric value of about 74.

In Example 1, shown by item B in FIG. 5, the stripline filter of FIG. 1 was tested against the Comparative Example A above. The stripline filter in Example 1 included a three pole filter with mirror imaged interior portions on the base and cover as in Comparative Example A, and similar input/output pads and the same dielectric was utilized. Example 1 differed from Comparative Example A in that in Example 1, a single inductive transmission line 38 on the cover was included, substantially as shown in FIG. 1. Example 1 also was tuned by removing conductive material 36 in tuned area 33, of the cover 28, to adjust the center frequencies of the resonators. As shown in FIG. 5, the high side transmission zero is suitably positioned, for providing the desired frequency response.

The addition of the new high side transmission zero provides a desired transfer function which attenuates certain unwanted signals at predetermined frequencies. This feature can provide an improvement in performance of stripline filters. Speculating, the stripline filter shown in FIG. 3 can be appropriately tuned and modified, to obtain a transfer function substantially similar to that shown as item B in FIG. 5.

Although the present invention has been described with reference to certain preferred embodiments, numerous modifications and variations can be made by those skilled in the art without departing from the novel spirit and scope of this invention.

What is claimed is:

1. A stripline filter having at least three poles and one zero in its frequency transfer function, comprising:

a dielectric base comprising an interior portion and an exterior portion;

at least three conductive strips defining an input resonator, a middle resonator and an output resonator on the interior portion of the base;

input and output pads coupled to the input and the output resonator, respectively; and a dielectric cover comprising an interior portion and an exterior portion, the exterior portion of the base and the exterior portion of the cover are substantially covered with a conductive material defining a ground plane, with the exception that a portion of the exterior of at least one of the cover, the base and the combination of both the cover and the base, is substantially uncoated to define a magnetic coupling means for coupling at least two alternate resonators in proximity to a grounded end thereof, the magnetic coupling means couples at least two alternate resonators in proximity to the grounded end of the alternate resonators, for providing a predetermined tunable frequency response with a high side transmission zero.

2. The stripline filter of claim 1, wherein the interior of the cover includes a substantially mirror-image of the interior portion of the base.

3. The stripline filter of claim 1, wherein the magnetic coupling means defines a magnetic transmission path coupling the input and the output resonators.

4. The stripline filter of claim 1, wherein the magnetic coupling means defines a magnetic transmission line path coupling the input and output resonator comprising the uncoated portion.

5. The stripline filter of claim 1, wherein the magnetic coupling means defines a magnetic path substantially isolated from the middle resonator.

6. The stripline filter of claim 6, wherein the magnetic path and an ungrounded end of the middle resonator are configured to minimize unwanted frequency responses.

7. The stripline filter of claim 5, wherein the magnetic path and grounded end of the middle resonator are physically spaced apart and substantially uncoupled.

8. A stripline filter having at least three poles and one zero in its frequency transfer function, comprising:

(a) dielectric base comprising an interior portion and an exterior portion;

(b) at least three conductive strips defining an input resonator, a middle resonator and an output resonator on the interior portion of the base;

(c) input and output pads coupled to the input and the output resonator, respectively; and (d) a dielectric cover comprising an interior portion and an exterior portion, the exterior portion of the base and the exterior portion of the cover are substantially covered with a conductive material defining a ground plane, with the exception that a portion of the exterior of the cover is substantially uncoated defining an inductive transmission line comprising the uncoated portion for coupling alternate resonators in proximity to a grounded end, the inductive transmission line couples at least two alternate resonators in proximity to the grounded ends thereof, for providing a predetermined tunable frequency response with a high side transmission zero.

9. The stripline filter of claim 8, wherein a plurality of stripline filters are connected in series to form a duplex filter.

10. The stripline filter of claim 8, wherein the input and output pads are capacitively coupled to an ungrounded portion of the input and the output resonators, respectively.

11. The stripline filter of claim 8, wherein the input and output pads are inductively coupled to a grounded portion of the input and the output resonators, respectively.

12. The stripline filter of claim 10, wherein the input and output pads are located on the exterior portion of the base.

13. The stripline filter of claim 12, wherein the input and output pads are each substantially surrounded by an unmetallized area.

14. A stripline filter having a plurality of poles and one zero in its frequency transfer function, comprising:

(a) a dielectric base including an interior portion and an exterior portion;

(b) at least four conductive strips defining at least an input resonator, first and second middle resonators, and an output resonator on the interior portion of the base;

(c) input and output pads coupled to the input and the output resonator, respectively; and (d) a dielectric cover comprising an interior portion and an exterior portion, the exterior portion of the base and the exterior portion of the cover are substantially covered with a conductive material defining a ground plane, with the exception that a portion of the exterior of at least one of the cover, the base, and the combination of both the cover and the base, is substantially uncoated to define an inductive transmission line for coupling at least two alternate resonators in proximity to a grounded end thereof, the inductive transmission line couples at least two alternate resonators in proximity to the grounded end of the alternate resonators, for providing a predetermined tunable frequency response with a high side transmission zero.

15. The stripline filter of claim 14, wherein the input resonator and the second middle resonator are coupled via the inductive transmission line.

16. The stripline filter of claim 14, wherein said at least four conductive strips define five or more resonators including a third middle resonator, and wherein the first middle resonator and the third middle resonator are coupled via the inductive transmission line at the grounded end.

17. The stripline filter of claim 14, wherein a plurality of filters are connected in series thereby forming a duplex filter.

* * * * *